United States Patent [19]

Westeren

[11] Patent Number: 4,462,577

[45] Date of Patent: Jul. 31, 1984

[54] APPARATUS FOR GAS COOLING WORK PARTS UNDER HIGH PRESSURE IN A CONTINUOUS HEAT TREATING VACUUM FURNACE

[75] Inventor: Herbert W. Westeren, Barrington, R.I.

[73] Assignee: C.I. Hayes Inc., Cranston, R.I.

[21] Appl. No.: 450,312

[22] Filed: Dec. 16, 1982

[51] Int. Cl.[3] ..... C21D 9/00

[52] U.S. Cl. ..... 266/250; 266/259

[58] Field of Search ..... 266/259, 130, 254, 250, 266/249, 252

[56] References Cited

U.S. PATENT DOCUMENTS

| | | | |
|---|---|---|---|
| 4,118,016 | 10/1978 | Westeren et al. | 266/130 |
| 4,171,126 | 10/1979 | Zahn et al. | 266/250 |

FOREIGN PATENT DOCUMENTS

| | | | |
|---|---|---|---|
| 2376214 | 9/1978 | France | 266/250 |
| 2487492 | 1/1982 | France | 266/259 |
| 630299 | 10/1978 | U.S.S.R. | 266/252 |
| 763663 | 9/1980 | U.S.S.R. | 266/250 |

*Primary Examiner*—L. Dewayne Rutledge
*Assistant Examiner*—Christopher W. Brody
*Attorney, Agent, or Firm*—Salter & Michaelson

[57] ABSTRACT

A vacuum furnace having a heating chamber for heat treating work parts under vacuum therein, and a cooling chamber located adjacent to the heating chamber for receiving the heat treated work parts for the rapid cooling thereof, the work parts being rapidly cooled in the cooling chamber by the circulation of a cooling gas therein, a high-velocity fan being provided in the cooling chamber for the rapid circulation of the cooling gas over the work parts, heat transfer means located in the cooling chamber and over which the cooling gas is circulated for withdrawing heat therefrom after the passage of the gas over the work parts, and a unique door arrangement being located in the cooling chamber to insure the sealing of the cooling chamber both during the evacuation thereof upon transfer of the work parts thereto and during the cooling cycle therein, whereby in the cooling cycle the pressurized cooling gas within the cooling chamber acts to seal an inner door so that the use of exterior clamps and/or locks for sealing the cooling chamber is avoided.

7 Claims, 4 Drawing Figures

APPARATUS FOR GAS COOLING WORK PARTS UNDER HIGH PRESSURE IN A CONTINUOUS HEAT TREATING VACUUM FURNACE

BACKGROUND OF THE INVENTION

The present invention relates to vacuum furnaces and is concerned primarily with the rapid quenching or cooling of work parts after the heat treatment thereof, and in this connection has application in both a continuous heat treating vacuum furnace of the type illustrated in applicant's prior U.S. Pat. No. 4,118,016 and in the batch-type of heat treating vacuum furnace, such as illustrated in applicant's prior U.S. Pat. No. 3,599,946. In both the continuous heat treating and the batch-type of vacuum heat treating furnaces as illustrated in the aforesaid U.S. patents, quenching of the heat treated work parts was accomplished by dumping the work parts directly into an oil vat immediately upon removal thereof from the heating chamber. Although vacuum quenching in oil has been normally successfully carried out heretofore in vacuum heat treating furnaces, in certain circumstances, and particularly if the temperature of the furnace was elevated above 2000° F., rapid quenching in oil sometimes resulted in cracking of the parts. Therefore, careful attention had to be given to the operating characteristics of the vacuum operated furnace that provided for quenching of the heat treated parts in a liquid such as oil, since severe damage thereto could result if the quenching operation was not properly performed. Further, quenching in oil after a period of heat treatment at elevated temperatures tended to promote carburization of the work parts, which detracted from the fundamental purpose of heat treating the parts and rapidly quenching in a liquid such as oil.

A prior known procedure for quenching work parts after the heat treating thereof has been quenching in an atmosphere, such as nitrogen; although prior techniques for accomplishing this purpose have necessarily resulted in excessive quenching periods. Examples of vacuum furnaces known to applicant that have used an atmospheric quenching medium are illustrated in applicant's prior U.S. Pat. Nos. 3,257,492; 3,342,469 and 3,431,346. Since production requirements for heat treating work parts do require a relatively short cycle, the prior known method of quenching in an atmosphere is now unacceptable since the heat treatment cycle is unduly extended and furthermore is useful only in the batch-type of heat treating furnace. Further, in the prior known processes that utilized a cooling gas for quenching, the cooling gas was usually maintained at a subatmospheric pressure or at a pressure just slightly higher than atmosphere. Under these conditions, heat transfer was limited. As will be described hereinafter, increasing the pressure of the quenching gas, increases conductivity and density of gas, thereby accelerating heat transfer for promoting rapid cooling.

SUMMARY OF THE INVENTION

The present invention relates to a vacuum furnace and a method for use therewith for processing work parts in a heating chamber for the heat treatment thereof and the rapid cooling of the work parts by using a cooling gas. Transfer means are provided for introducing work parts into the heating chamber from a loading chamber during a heating cycle, and internal doors are also provided for sealing the heating chamber wherein the work parts are heated therein under a predetermined vacuum and temperature. In order to provide for rapid cooling of the work parts after the heating cycle thereof, a cooling chamber is located in close proximity to the heating chamber and is selectively disposed in communication therewith through an internal door. Additional transfer means are utilized to transfer the work parts from the heating chamber to the cooling chamber after the heating cycle, and a unique door arrangement is located in the cooling chamber to seal the cooling chamber upon the evacuation thereof to a subatmospheric pressure when the work parts are transferred thereto. The door arrangement further includes an internal door that is operable in response to pressure thereagainst upon the pressurizing of the cooling chamber during the cooling cycle to seal the cooling chamber. Because of the unique arrangement of the door arrangement in the cooling chamber, special clamps or breech locks are avoided which are normally used in furnaces where cooling is carried out in pressures above atmospheric.

In the cooling cycle as carried out by the subject invention, a cooling gas such as vaporized nitrogen is introduced into the cooling chamber and rapidly circulated therein over the work parts and recycled through heat transfer means, so that the cooling cycle is materially decreased in time. Special heat transfer members in the form of finned tubes through which a cooling fluid is circulated are located in the cooling chamber and the cooling gas is circulated thereover after contact with the work parts, so that heat is rapidly withdrawn from the cooling gas prior to recirculation thereof over the work parts. This rapid recirculation of the cooling gas and the withdrawal of heat therefrom, promotes a reduced cooling cycle from that known heretofore when utilizing a cooling gas.

Accordingly, it is an object of the present invention to provide a vacuum furnace for heat treating metal articles in a subatmospheric environment, wherein the work parts are transferred from a heating chamber to a cooling chamber that is pressurized by a cooling gas, the cooling gas being circulated in the cooling chamber for the rapid cooling of the work parts. Means are further provided in the cooling chamber for withdrawing heat from the cooling gas as it circulates therethrough.

Another object of the invention is to provide a vacuum-operated furnace for heat treating metal articles and that includes a cooling chamber having a door arrangement that enables the cooling chamber to be initially placed at a subatmospheric pressure for receiving the heat treated articles, and thereafter operated at pressures higher than atmospheric during the cooling cycle without the use of special door locks or the like.

Still another object is to teach a method of heat treating work parts in a heat treating furnace, wherein a unique process for rapidly cooling the work parts in a pressurized cooling chamber is performed.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
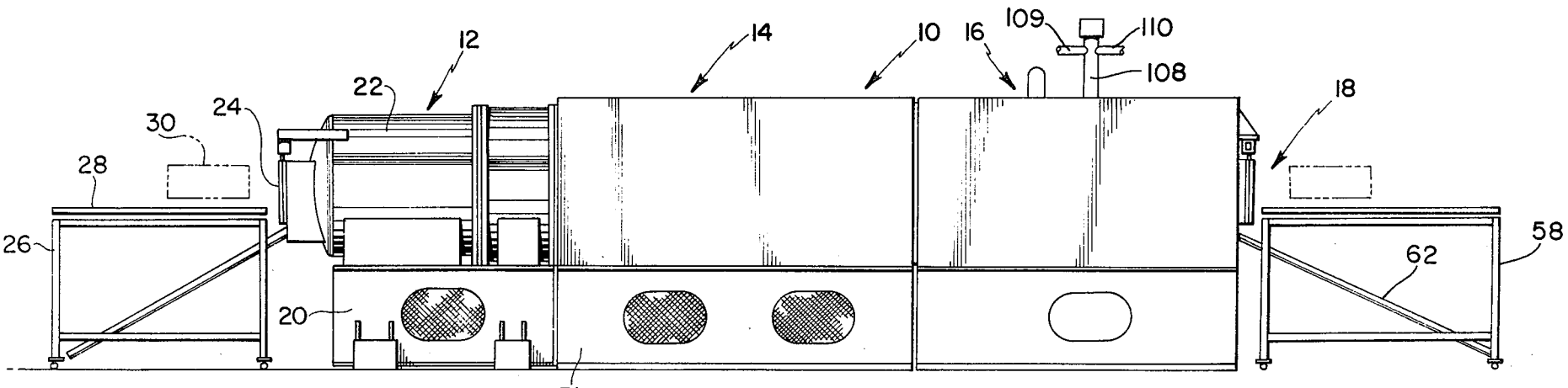
FIG. 1 is a side elevational view of the heat treating vacuum furnace as embodied in the present invention.
Figure 2:
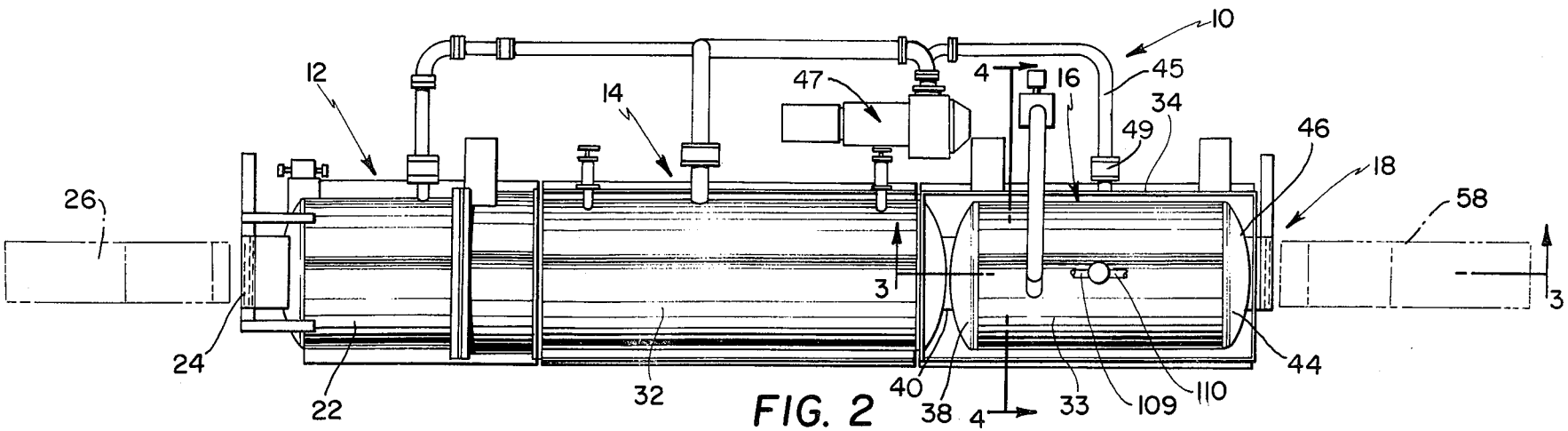
FIG. 2 is a top plan view thereof.

Referring now to the drawings and particularly to FIGS. 1 and 2, the vacuum furnace as embodied in the present invention is illustrated and is generally indicated at 10. The vacuum furnace 10 is of the continuously-operating type that is illustrated in applicant's prior U.S. Pat. No. 4,118,016; but as will be more fully described hereinafter, the present invention includes a cooling chamber that communicates with the heating chamber of the furnace and receives a cooling gas therein for the rapid cooling of the work parts as transferred thereto, and in this manner is distinguished from the furnace as illustrated in U.S. Pat. No. 4,188,016, which includes an oil quench cooling system therein.

In the normal operation of the vacuum furnace 10, work parts are introduced into a heating chamber that is maintained at subatmospheric conditions, the furnace continuously receiving and processing the work parts without the requirement of discontinuing the operation of the furnace heating chamber or breaking the vacuum therein. As will be apparent, the furnace 10 can be employed for a variety of heat treating operations such as sintering and brazing and has particular application in the continuous carburizing of metal work parts under vacuum.

As shown in FIGS. 1 and 2, the vacuum furnace 10 as illustrated therein includes a loading section, generally indicated at 12, a heating section generally indicated at 14, a cooling section generally indicated at 16 and that includes a discharge station and an unloading station generally indicated at 18. The loading station 12, heating section 14, cooling section 16 and the unloading station 18 are all located in end-to-end relation to define the complete furnace construction 10; and the loading, heating and cooling units are further constructed such that they are easily assembled and are generally modular in arrangement for modifying the location of the units as required.

Referring again to FIGS. 1 and 2, the loading section 12 as shown is mounted on a base 20 and in this connection is substantially the same construction as the loading station shown in U.S. Pat. No. 4,118,016. The loading station 12 includes a cylindrical chamber or shell 22 on which a front door assembly 24 is mounted, the front door assembly 24 being operable to provide for entry of work parts into the loading section shell 22 during the operation of the furnace. A loading table 26 that defines a loading station is normally located at the loading end of the furnace 10 and receives work carts thereon, one of which is represented at 28. The work cart 28 receives a tray 30 (illustrated in phantom) thereon in which work parts to be heat treated are loaded. The work cart 28 and tray 30 as illustrated are representative of the work parts to be processed in the furnace and are manually introduced into the chamber 12 by way of a door opening that is controlled by the door 24. Located downstream of section 12 is a heating section 14 that is mounted on a base 31, the construction of the heating section 14 being substantially similar to the heating section illustrated and described in U.S. Pat. No. 4,118,016. In this connection the heating section 14 also includes a chamber 32 in which an interior heating station is defined for receiving the work parts therein. Communication between the loading chamber 22 and heating chamber 32 is controlled by an interior door assembly (not shown) that is operable at timed intervals to provide for entry of the work parts into the heating chamber.

Figure 3:
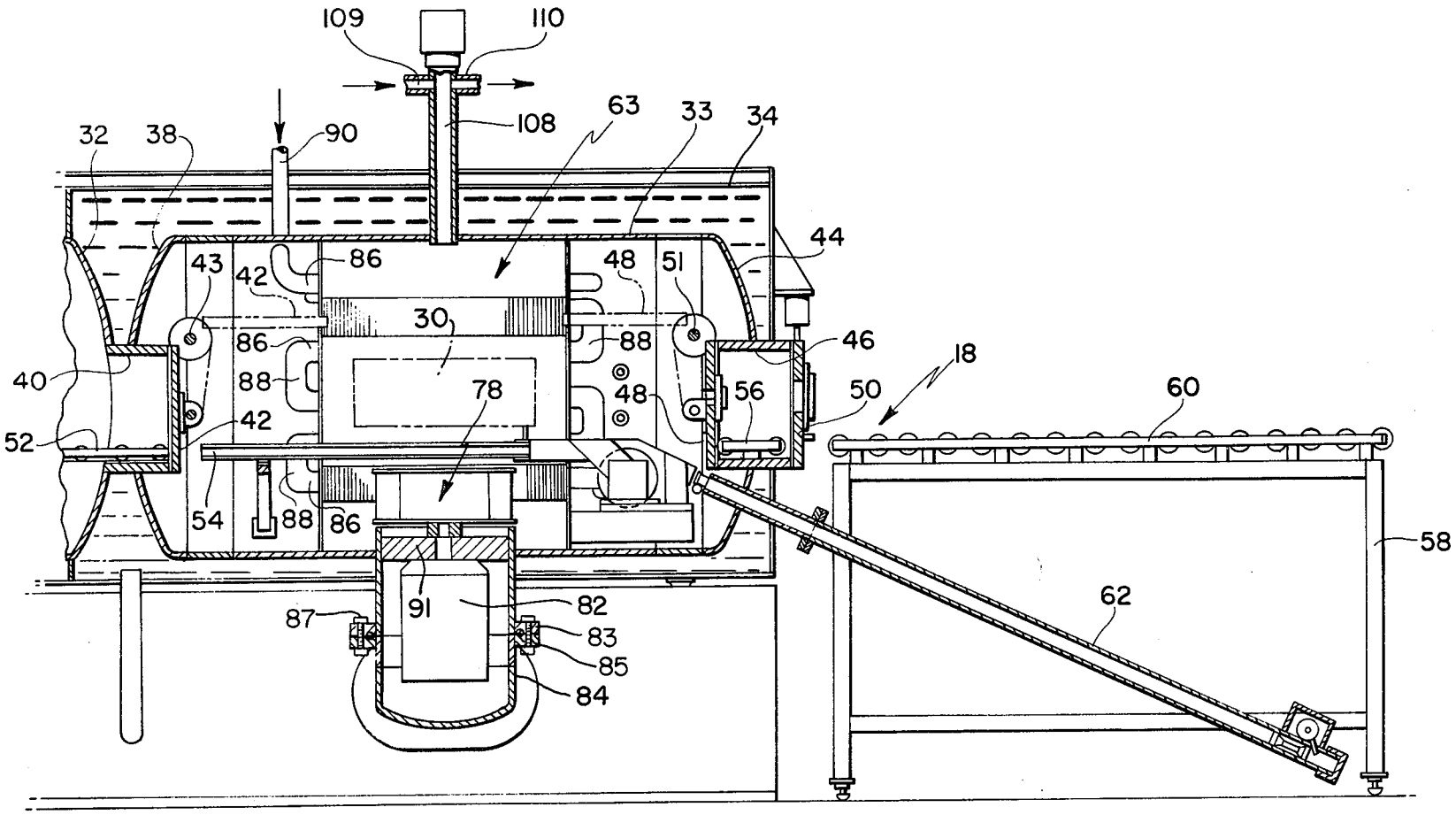
FIG. 3 is a sectional view taken along line 3—3 in FIG. 2.
Figure 4:
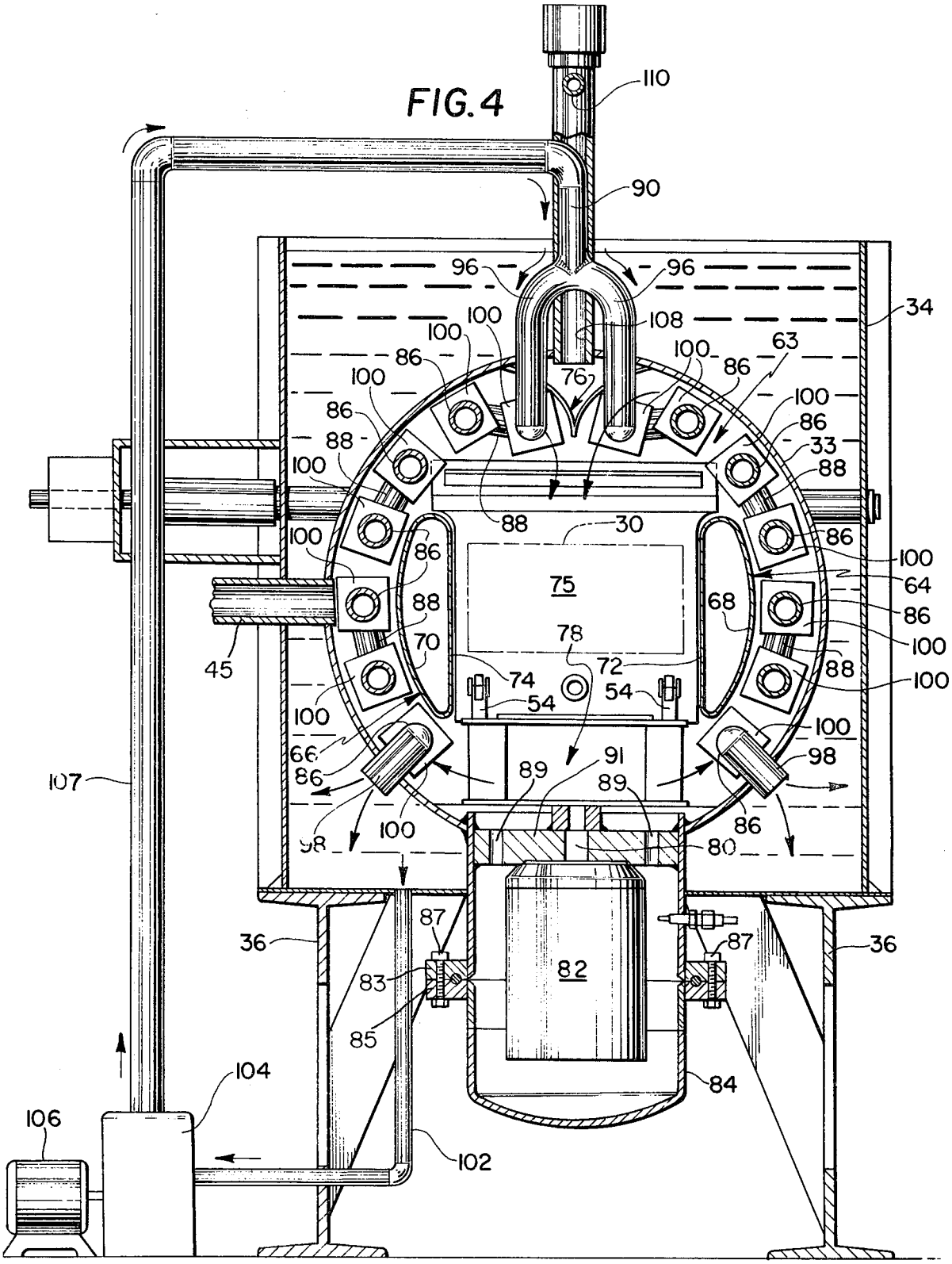
FIG. 4 is a sectional view taken along line 4—4 in FIG. 2 and shows the heat transfer and gas cooling systems as used in connection with the cooling chamber.

Referring now to FIGS. 3 and 4, the cooling section 16 is illustrated in more detail, and as shown, is defined by a cylindrical housing or chamber 33 that is located within an exterior shell or vessel 34 that has a substantially rectangular configuration as seen in cross-section (FIG. 4). The vessel 34 is mounted on support beams 36 that extend longitudinally of the furnace 10 and that define a base for supporting the other sections of the furnace assembly. The cylindrical chamber 33 of the cooling section 16 includes a forward domed wall 38 having a central opening formed therein for receiving an inner cylindrical compartment 40 that provides for communication between the interior of the heating chamber 32 and the interior of the cooling chamber 33. An interior door member indicated at 42 is operable by a control shaft 43 to control communication between the compartment 40 and the interior of the cooling chamber, a control for the shaft 43 being programmed to operate at timed intervals, wherein the door member 42 is lifted from the vertical position as shown in FIG. 3 to a horizontal open position as shown in phantom in FIG. 3. As will be described, work parts are transferred from the heating chamber 14 to the cooling chamber 33 through the compartment 40 after the heating cycle thereon has been completed. The operating mechanism and structure of the door member 42 are also more clearly illustrated and described in U.S. Pat. No. 4,118,016.

In order to evacuate the cooling chamber 33 for introducing the heated work parts therein, an evacuation pipe 45 is employed (FIG. 4) which provides communication between the interior of the chamber 33 and the system vacuum pump indicated at 47 in FIG. 2. A control valve 49 controls the evacuation of the cooling chamber as required.

The rearmost end of the cooling chamber 33 is defined by a rear domed wall 44 that has an opening in which a tubular discharge compartment 46 is located. Mounted on the interior end of the discharge compartment 46 is an interior door member 48 that is constructed and arranged similarly to the door member 42 and that is operable by a shaft 51. The shaft 51 is programmed to operate at timed intervals during a cooling cycle and moves the door member 48 from a closed vertical position, to an open position as shown in phantom lines in FIG. 3, wherein the door member 48 is disposed generally horizontal. In order to close the outermost end of the discharge compartment 46, a door member 50 is provided; and although not shown, a mechanism is provided that moves the door member 50 to and from the closed and open positions thereof in a lateral or transverse motion. As will be described, it is not necessary to bolt or lock the door member 50 to the discharge compartment 46 by external fastening devices prior to or during the cooling cycle, since the door member 50 is sealed in position when the cooling chamber is evacuated to receive work parts therein, the differential pressure between the outside of the door member 50 and the interior of the cooling chamber 33 and the discharge compartment 46 insuring that the door member 50 will be urged into tight sealing engagement against the outermost edges of the discharge compartment 46. During the cooling cycle the pressure of the cooling medium urges the interior door member 48 into sealing engagement with the interior edges of the compartment 46 which avoids the need for sealing the door member 50 against the compartment 46, as will be described hereinafter.

As more clearly illustrated in FIG. 3, the work parts as mounted on a cart 28 are moved into and out of the heating station of the heating chamber 32 on spaced tracks 52. Aligned with the tracks 52 and mounted in the cooling chamber 33 are spaced tracks 54 onto which the cart 28 and the work load 30 are received when the work load is moved into the cooling chamber 33 just prior to the beginning of the cooling cycle. Similarly, shortened tracks 56 are located in the discharge compartment 46 and are aligned with the tracks for receiving cart 28 thereon. A table 58 is located exteriorly of the furnace 10 at the unloading station 18 and adjacent to the discharge compartment 46. Mounted on the table 58 are tracks 60 that are disposed in alignment with the tracks 56. As the cart 28 and the work load mounted thereon are moved from the interior of the cooling chamber 33 on the tracks 54 and then through the discharge compartment 46 on the tracks 56, the cart 28 is received on the tracks 60 for further handling of the work parts as contained in the work basket 30 that is mounted on the cart. Although not illustrated in detail herein, a discharge work transfer device generally indicated at 62 extends inwardly into the cooling chamber 33 in an inclined manner. A coupling member (not shown) is movable within the transfer device 62 for engagement with a work cart 28 for transfer of the work cart from the tracks 52 in the heating chamber onto the tracks 54 in the cooling chamber; and then after completion of the cooling cycle, the work cart is transferred through the compartment 46 on the tracks 56 from which the work cart is pulled onto the track 60 of the table 58. The discharge transfer mechanism 62 is somewhat different in location than that illustrated in U.S. Pat. No. 4,118,016, but the structure and operation thereof are substantially similar.

One of the unique features of the subject invention is the rapid cooling of the work parts in the cooling chamber after the transfer thereof from the heating chamber. This rapid cooling or quenching is accomplished without the use of any quenching liquid such as oil, which was commonly employed as a cooling medium in vacuum heat treating apparatus heretofore. In the present invention, a unique gas quenching system is utilized to accomplish the rapid quenching of the work parts; and in order to promote the proper circulation of quenching gas within the cooling chamber 33, a cage member generally indicated at 63 is provided; and as shown in FIGS. 3 and 4, the cage member 63 is disposed centrally of the chamber 33 and has a configuration that conforms to the tubular construction of the chamber 33. Located interiorly of the cage member 63 are a pair of opposed baffles 64 and 66. As shown in FIG. 4, the baffles 64 and 66 include arcuate shaped walls 68 and 70, respectively, that are spaced from the interior wall of the chamber 33 and that extend generally parallel therewith. The baffles 64 and 66 are also provided with vertical walls 72 and 74, respectively, between which a space is defined that forms a cooling station 75 at which the work parts that are to be quenched are received. A third gas directing baffle 76 is located at the uppermost end of the cylindrical cooling chamber 33 as part of the cage member 63 and is formed with concave walls that converge to join at the lowermost ends thereof. As shown in FIG. 4, the concave walls of the baffle 76 direct cooling gas flowing into contact therewith in a downwardly direction between the baffles 68, 70 and through the cooling station 75 at which the work parts are located.

Rapid circulation of the cooling gas within the cooling chamber 33 is provided by a high-velocity fan 78 that is located at the lowermost end of the chamber 33 and at approximately the midpoint thereof. The fan 78 is mounted for rotation on a shaft 80 that extends upwardly from a motor 82 that is mounted within a motor housing 84. The motor housing 84 is formed in two parts having flanges 83 and 85 that are secured together in sealed relation by bolts 87, the uppermost part of the motor housing 84 being joined to the lowermost end of the chamber by welding. Passages 89 are also formed in a web 91 that enable the interior of the housing 84 to remain at the same pressure as the chamber 33. It is seen that upon rotation of the fan 78, cooling gas that is introduced into the cooling chamber is directed outwardly in a centrifugal manner to the passages as defined between the baffles 68 and 70 and the inner adjacent wall of the chamber 33 spaced therefrom. The gas is directed upwardly in rapid fashion following the contour of the chamber 33 for contact with the walls of the baffle 76, and is then directed downwardly over the work parts located at the cooling station 75 between the baffles 68 and 70.

In order to obtain efficient cooling of the work parts in the circulation of the cooling gas thereover, a unique heat transfer assembly is provided that is constructed as part of the cage 63, the heat transfer assembly functioning to withdraw heat from the cooling gas after it has circulated over heated work parts that have been transferred to the cooling chamber from the heating chamber. This heat transfer process is accomplished by directing the cooling gas over a series of heat transfer members having a plurality of cooling fins fixed thereon. Referring again to FIGS. 3 and 4, the heat transfer members are shown comprised of two systems or branches, each of which includes a series of longitudinally extending pipes 86 that are disposed in spaced parallel relation and that are joined at the outermost ends thereof by a series of end pipes indicated at 88 that cooperate with the pipes 86 to define a continuously extending pipe having a zig-zag configuration. Cold water is introduced into the topmost pipe 86 of each system by way of an inlet pipe 90; and is circulated through the remaining pipes 86 within the cage 63 for eventual discharge into the vessel 34. As will be described hereinafter, the water is continuously withdrawn from the vessel and recirculated back to the inlet pipe 90 for circulation again through the pipes 86. As shown more clearly in FIG. 4, the pipes 86 that are divided into the two sections form part of the cage 63 and are shaped and constructed for being received within the cylindricai chamber 33 in which the cooling station 75 is located. Communicating with the inlet pipe 90 are branch pipes 96 that are located at the uppermost end of the chamber 33, the branch pipes 96 being connected directly to the uppermost pipe 86 of each branch of the heat transfer pipes. Water as fed to the uppermost pipes 86 of each branch is circulated through the pipes in a zig-zag manner as shown in FIG. 3, and then is discharged at the lowermost end of the chamber 33 into the bottom of the vessel 34 by way of exit pipes 98.

The effective removal of heat from the circulating cooling gas is accomplished by the use of a plurality of metal fins 100 that are joined to the pipes 86 throughout the length of the cage 63. The fins 100 which are substantially square in configuration occupy a substantial portion of the passages formed between the arcuate walls 68 and 70 of the baffles 64,66 and the inner surfaces of the walls of the chamber 33. As the cooling gas passes downwardly over the work parts located at the cooling station 75, it is drawn into the fan 78 and centrifugally expelled into the passages in which the pipes 86 and fins 100 mounted thereon are located. Since cooled water is circulated through the pipes 86, the fins 100 and pipes 86 act to effectively withdraw heat from the cooling gas before it is again circulated over the work parts at the cooling station.

The effective cooling of the work parts in a reduced period of time requires that the water passing through the heat transfer pipes 86 be rapidly circulated so that relatively cool water is continually introduced into the pipes 86 at the top of the cage that defines the heat transfer assembly. For this purpose, the water circulating through the pipes 86 is discharged by way of exit pipes 98 into the bottom of the vessel 34 which is substantially filled with water. The heated water is immediately cooled after entering the vessel 34, and circulation of cooled water to the inlet pipe 90 is accomplished by withdrawing a predetermined quantity through a pipe 102 that communicates with a pump 104 driven by a motor 106. The pump 104 which is operated to supply a predetermined flow of water to the heat transfer assembly directs the water upwardly therefrom through a supply pipe 107 which terminates at the inlet pipe 90 that is located at the uppermost end of the vessel 34. As previously described hereinabove, the water is introduced into the heat transfer pipes 86 by way of the inlet pipe 90 and the branch pipes 96.

The cooling gas that is circulated for rapidly cooling the work parts at the cooling station is introduced interiorly of the chamber 33 by way of a pipe 108 that communicates with a gas inlet pipe 109 (FIG. 3). The gas is also evacuated from the housing 33 through the pipe 108 and then through a purge pipe 110. The cooling gas is preferably vaporized liquid nitrogen; although other forms of gas, such as argon or helium, can be utilized, it being only necessary that the gas be substantially inert for compatability with the metal being heat treated. Such inert gases are relatively inexpensive and are readily available, which materially decreases the effective cost of carrying out the heat treating process. As more clearly shown in FIG. 4, the gas that has been introduced into the interior of the cooling chamber by way of the pipe 108 and gas inlet pipe 109 is drawn downwardly over the work parts by the high-velocity impeller 78. The gas that is drawn into the impeller 78 is directed outwardly therefrom, as previously described, and through the passages formed between the baffles 64 and 66 and the adjacent spaced wall of the chamber 33. As the cooling gas passes over the finned pipes 86, the heat is withdrawn therefrom and the gas thereafter is directed downwardly over the work parts again by the baffle 76. It is seen therefore that after the cooling gas is introduced into the cooling chamber 33 to obtain a predetermined pressure therein, it is continuously circulated by the impeller 78 over the work parts, heat being withdrawn from the circulating gas by the heat transfer pipes 86 and the fins 100 fixed thereto.

OPERATION

In describing the operation of the heat treating furnace that is embodied in the subject invention, it will first be assumed that the work parts are located in the heating chamber 32 and are to be transferred to the cooling chamber 33 for the rapid cooling thereof. Before the work parts can be transferred from the heating chamber 32 to the cooling chamber 33, the cooling chamber must be evacuated to a subatmospheric environment corresponding to that of the interior of the heating chamber. In this connection, the heating chamber is always maintained under vacuum, even during the cooling cycle, since other work parts have been transferred thereto for the prescribed heating cycle, and in this manner the furnace can carry out a continuous vacuum heat treating of work parts. Prior to evacuating the cooling chamber, the cooling gas is purged therefrom through the pipe 108 and the purge pipe 110, shown in FIG. 3. The cooling chamber 33 is then evacuated through the pipe 45 to the subatmospheric pressure that corresponds to the vacuum in the heating chamber.

Prior to evacuating the cooling chamber 33, the control mechanism that operates the shaft 49 of the interior door assembly located at the discharge end of the cooling chamber is energized to move the door 48 to the horizontal position as shown in phantom in FIG. 3. This exposes the cooling chamber 33 to the interior of the discharge compartment 46 and the door 50. The door 50 in this position is located in the closed position thereof and has been slidably moved to the closed position by the appropriate control therefor. At this time, the interior door 42 that controls communication between the heating chamber and the cooling chamber remains in the closed position so as to retain the vacuum in the heating chamber. As the cooling chamber is evacuated by way of the pipe 45 and the cooling chamber pressure is reduced, the reduction in pressure produces a differential pressure between the interior and exterior sides of the door 50. The door is then drawn into tight-sealing engagement with the end of the discharge chamber 46 to effectively seal the discharge end of the cooling chamber.

With the cooling chamber now evacuated to the prescribed subatmospheric pressure, the door 48 is closed and the control for the shaft 43 of the interior door 42 is actuated to move the door 42 to the open horizontal position as shown in phantom in FIG. 3. The transfer mechanism which has been operated for moving the work carts 28 within the heating chamber now operates to transfer the furthermost work cart 28 to a position at which the transfer mechanism 62 is then operated to withdraw the forwardmost located work cart 28 and the work basket 30 thereon through the compartment 40 and onto the rails 54 within the cooling chamber. The transfer mechanism 62 then locates the work cart 28, work basket 30 and the work parts therein at the cooling station 75 within the cage 63.

With the work parts located at the cooling station 75, the interior door 42 is moved to the closed positions thereof as shown in FIG. 3. Thereafter the cooling chamber 33 is backfilled with vaporized liquid nitrogen that is introduced therein by way of the gas inlet pipe 109 and pipe 108. Since both of the doors 42 and 48 pivot downwardly and into contact with the adjacent surfaces of the compartments 40 and 46, the doors are effectively sealed thereagainst as the pressure in the cooling chamber increases above atmospheric. When the pressure of the cooling gas reaches approximately one-half an atmosphere in the cooling chamber, the circulating fan 78 is started by the energizing of the motor 82. The cooling gas continues to be introduced into the cooling chamber until a pressure of approximatey 100 psig in the chamber is reached. At this point the flow of the cooling gas into the cooling chamber is discontinued but the circulation of the gas continues through the closed heat transfer and exchange system.

Because of the rapid circulation of the cooling gas over the work parts, and further because of the effective withdrawal of heat from the cooling gas as it is moved over the heat transfer pipes 86 and fins 100, the cooling cycle is accomplished in a relatively short period of time, the length of the cooling period depending upon the load that is being cooled. Under normal conditions and with only an average load located at the cooling station, heat is removed from the work parts to a temperature that is less than 100° F. in approximately 5 minutes.

At the end of the cooling cycle, the exhaust valve controlling the gas outlet pipe 110 is opened, and with the gas inlet pipe having been previously closed, the cooling chamber 33 is depressurized by purging the cooling gas therefrom until the pressure within the cooling chamber reaches approximately atmospheric. The vacuum in the discharge compartment is broken by energizing a solenoid operated vent valve (not shown) that communicates with the discharge compartment through a suitable pipe (not shown). The exit doors 48 and 50 are then opened and the work cart is moved from the cooling chamber to the discharge compartment 46 by means of the extractor mechanism 62 and then manually moved onto the table 58 of the discharge station 18. Thereafter, the outside exit door 50 is closed and the inner exit pressure door 48 is moved to the open position once again as shown in phantom in FIG. 3, and the cooling chamber is then reevacuated to approximately 500 microns (½ mm). The vacuum valve controlling the evacuation of the cooling chamber is then closed, the inner exit pressure door 48 is also closed, and the cycle is repeated.

During the cooling cycle, it is seen that the circulation baffle 76 avoids the creating of turbulence of the cooling gas as it is recirculated by the high-velocity blower 78. The two paths through which the cooling gas is recirculated are independent of each other; and as the cooling gas strikes the circulation baffle 76, it is directed downwardly over the work parts in an even flow. Further, the air foil baffle sections 64 and 66 insure that the cooling gas is directed over the fins 100 as fixed to the heat transfer tubes 86. Thus the transfer of heat from the cooling gas is accomplished in an effective manner prior to the gas being recirculated over the work parts that are to be cooled. In order to provide for the effective efficiency of the cooling gas, a gas flow of approximately 50 feet per second is maintained.

The effective cooling of the work parts by the cooling gas is, of course, obtained by the circulation of the cooling water through the heat transfer system, including the pipes 86 and vessel 34. In order to provide for the efficient transfer of heat from the circulating gas, the cooling water is circulated through the pipes 86, vessel 34, pump 104 and entrance pipes 107 and 90 at approximately 12 feet per second. The high-velocity fan 78 insures that the gas flow is sufficient to provide a cooling effect by the water-cooled pipes, and it is thus seen that the overall efficiency of the heat transfer from the gas is insured by the effective water flow through the heat transfer pipes.

Another of the unique features of the invention is the closing of the furnace doors without the use of any clamps or locks. Thus, when the cooling chamber is evacuated, the exterior exit door 50 is moved into a closed position and is tightly sealed thereagainst as the interior of the cooling chamber is reduced to a subatmospheric pressure. When the cooling chamber is to be pressurized, the interior exit door 48 is closed against the discharge compartment 46 and the pressure against the interior of the door 48 as exerted by the pressure of the gas in the cooling chamber forces it against the compartment 46 to effectively seal the discharge area. Both doors 48 and 50 as indicated are sealed without any clamping means being utilized.

It is understood that the vacuum pressures referred to in the description of the operating cycle hereinabove are only representative of one cycle of operation, and the operating conditions employed will be predetermined by the heat treating requirement of the work load. The temperature in the heating chamber is also varied in accordance with the work load to be heat treated and time intervals for the cycle will again be predetermined in accordance with the heat treating requirements.

It is also understood that all of the operations of the various motors that control the load and unload mechanisms, the door assemblies, the evacuation and purging of the loading shell 22 and cooling chamber 33 are all automatic and are timed in accordance with the characteristics of the metal parts being heat treated. An appropriate console is located adjacent to the furnace 10 and is electrically connected to the various operating mechanisms so that the system is preset and upon operation of the starting motor the cycle begins and is carried out automatically. It is understood of course that loading of a cart into the loading shell 22 and withdrawal at the discharge station is carried out manually, although this also may be accomplished automatically if required.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A vacuum furnace for processing work parts in a heating chamber for the heat treatment thereof, comprising means for introducing work parts into said heating chamber during a heat treatment cycle, means for sealing said heating chamber for heat treating said work parts under a predetermined vacuum and temperature therein, a cooling chamber located in close proximity to said heating chamber and being selectively disposed in communication therewith, means for transferring said work parts from said heating chamber to a cooling station in said cooling chamber after said heat treatment cycle for the rapid cooling of said work parts prior to the discharge thereof from said cooling chamber, and means for rapidly cooling said work parts at said cooling station without the immersion thereof in a cooling fluid, said cooling means including an open-ended cylindrical cage located in said cooling chamber, and defining the cooling station therein and in which said work parts are moved from said heating chamber for the rapid cooling thereof, a high velocity impeller located in said cooling chamber for rapidly circulating a pressurized cooling gas within said cage for movement over and around said work parts for the rapid cooling thereof, and heat transfer members disposed in said cooling chamber over which said cooling gas is directed by said impeller after contact thereof with said work parts for withdrawing heat therefrom prior to recirculation into contact with said work parts, said cooling means further including a closed fluid system through which a cooling fluid is recirculated, said cooling gas being circulated by said impeller into contact with said heat transfer members for transfer of heat therefrom and for maintaining said cooling gas at a temperature that is sufficiently low enough to cool said work parts at said cooling station within a limited period of time, said furnace further comprising a discharge compartment communicating with said cooling chamber on the downstream side thereof, an interior exit door mounted on said load discharge compartment for controlling access of a load therefrom following a cooling cycle, means for removing work parts from said cooling chamber for transfer to said discharge compartment after the cooling cycle for discharge from said furnace, means for controlling the operation of said interior exit door to permit the discharge of said work parts through said discharge compartment, said interior exit door being responsive to the pressurized cooling gas thereagainst within said cooling chamber to maintain a sealed position relative to said discharge compartment during the cooling cycle, an exterior exit door mounted on the exterior end of said discharge compartment and cooperating with said interior exit door to seal the cooling chamber during the cooling cycle, and means for laterally sliding said exterior exit door to and from the closed position thereof, said exterior exit door remaining in a close position without the use of special clamping means therewith when said interior exit door is sealed against said discharge compartment by the pressurized cooling gas during the cooling cycle, and being forced into positive sealing position against the discharge compartment when said cooling chamber is under vacuum.

2. A vacuum furnace for processing work parts in a heating chamber for the heat treatment thereof, comprising means for introducing work parts into said heating chamber during a heat treatment cycle, means for sealing said heating chamber for heat treating said work parts under a predetermined vacuum and temperature therein, a cooling chamber located in close proximity to said heating chamber and being selectively disposed in communication therewith, means for transferring said work parts from said heating chamber to a cooling station in said cooling chamber after said heat treatment cycle for the rapid cooling of said work parts prior to the discharge thereof from said cooling chamber, and means for rapidly cooling said work parts at said cooling station without the immersion thereof in a cooling fluid, said cooling means including an open-ended cylindrical cage located in said cooling chamber, and defining the cooling station therein and in which said work parts are moved from said heating chamber for the rapid cooling thereof, a high velocity impeller located in said cooling chamber for rapidly circulating a pressurized cooling gas within said cage for movement over and around said work parts for the rapid cooling thereof, and heat transfer members disposed in said cooling chamber over which said cooling gas is directed by said impeller after contact thereof with said work parts for withdrawing heat therefrom prior to recirculation into contact with said work parts, said cooling means further including a closed fluid system through which a cooling fluid is recirculated, said cooling gas being circulated by said impeller into contact with said heat transfer members for transfer of heat therefrom and for maintaining said cooling gas at a temperature that is sufficiently low enough to cool said work parts at said cooling station within a limited period of time, said cooling chamber having an interior discharge door located at the discharge end thereof, means for moving said interior discharge door to an open and a closed position by a pivoting action, wherein the interior discharge door is located in a vertical position when closed and in a horizontal position when open, an exterior discharge door located in spaced relation with respect to said interior discharge door and providing access of said work parts to the exterior of said cooling chamber following the completion of the cooling cycle, means for moving said exterior discharge door in a sliding motion to and form the open and closed positions thereof, said interior discharge door being responsive to the pressure of the cooling gas within said cooling chamber to seal said cooling chamber during the cooling cycle, and said exterior discharge door being responsive to a vacuum created in said cooling chamber to seal said cooling chamber during a transfer of said work parts from said heating chamber to the cooling chamber following the heating cycle.

3. A vacuum furnace for processing work parts in a heating chamber for the heat treatment thereof, comprising a housing in which said heating chamber is located, means for introducing work parts into said heating chamber, means for sealing said heating chamber for heat treating said work parts under a predetermined vacuum and temperature therein, a cooling chamber located downstream of said heating chamber and being selectively disposed in communication therewith, a first door means for sealing communication between said heating and cooling chambers, means for transferring said work parts from said heating to said cooling chamber after the heating cycle, means for introducing a cooling gas under pressure into said cooling chamber during the cooling cycle, means for rapidly circulating said cooling gas in said cooling chamber under pressures greater than atmospheric during the cooling cycle, and discharge door means located at the discharge end of said cooling chamber for sealing communication between the interior and exterior of the discharge end of said cooling chamber, said discharge door means including a first door that is responsive to the pressure of the cooling gas at pressure greater than atmospheric in said cooling chamber to seal the discharge end of cooling chamber during the cooling cycle, and further including a second door that is responsive to the vacuum in said cooling chamber during transfer of work parts thereto from said heating chamber to seal the discharge end of said cooling chamber.

4. A vacuum furnace as claimed in claim 3, said discharge door means further including a tubular discharge compartment mounted in said cooling chamber at the discharge end thereof, said first door being mounted on the interior side of said discharge compartment for location interiorly of said cooling chamber and said second door being spaced from said first door and being mounted on the exterior side of said discharge compartment for location exteriorly of said cooling chamber.

5. A vacuum furnace as claimed in claim 4, said first door being pivotally movable from a closed vertical position to an open horizontal, position to permit discharge of work parts into said discharge compartment and said second door being mounted for lateral sliding movement from the closed to the open position to expose the discharge compartment for removal of work parts therefrom.

6. A vacuum furnace as claimed in claim 5, said first door being disposed in vertical relation in the closed position thereof against the interior end of said discharge chamber, wherein the periphery of the first door is urged into engagement with the inner edges of said discharge compartment in a positive sealing action when the cooling gas is introduced into said cooling chamber under pressures greater than atmospheric.

7. A vacuum furnace as claimed in claim 5, the periphery of said second door being urged into positive sealing engagement with the outer edges of said discharge compartment and without the use of external clamps when the cooling chamber is placed under vacuum during a transfer of said work parts from said heating chamber to said cooling chamber.

* * * * *